US010138691B2

(12) United States Patent
Kos et al.

(10) Patent No.: US 10,138,691 B2
(45) Date of Patent: Nov. 27, 2018

(54) MOBILE SERVICE RIG WITH INTEGRATE PIPE HANDLING ASSEMBLY

(71) Applicant: OPTION INDUSTRIES INC., Drayton Valley (CA)

(72) Inventors: Dustin Kos, Drayton Valley (CA); Marlin Belanger, Drayton Valley (CA); Preston Kurash, Drayton Valley (CA)

(73) Assignee: Option Technologies Corp., Drayton Valley (CA)

( * ) Notice: Subject to any disclaimer, the term of this patent is extended or adjusted under 35 U.S.C. 154(b) by 0 days.

(21) Appl. No.: 14/743,616

(22) Filed: Jun. 18, 2015

(65) Prior Publication Data

US 2015/0376962 A1 Dec. 31, 2015

Related U.S. Application Data

(60) Provisional application No. 62/018,293, filed on Jun. 27, 2014.

(51) Int. Cl.

| | |
|---|---|
| ***E21B 19/15*** | (2006.01) |
| ***E21B 19/00*** | (2006.01) |
| ***E21B 15/00*** | (2006.01) |
| ***E21B 7/02*** | (2006.01) |

(52) U.S. Cl.

CPC ..... *E21B 19/155* (2013.01); *E21B 7/023* (2013.01); *E21B 15/00* (2013.01)

(58) Field of Classification Search

CPC ..... E21B 19/155; E21B 19/15; E21B 19/20
USPC ..... 164/269; 175/52, 85; 182/69.5; 212/304; 298/11; 414/22.51–22.59, 414/22.61–22.69, 22.71, 23, 458, 742, 414/743, 745.1, 779, 919; 52/119, 120, 52/745.11, 745.17, 745.18; 74/519, 520; 89/1.801, 1.815; 254/9 R

See application file for complete search history.

(56) References Cited

U.S. PATENT DOCUMENTS

| | | | | | |
|---|---|---|---|---|---|
| 1,264,432 | A * | 4/1918 | Palm | B60P 1/34 | 254/124 |
| 1,322,156 | A * | 11/1919 | Wright | B60P 1/34 | 298/11 |
| 2,792,198 | A * | 5/1957 | Braun | E21B 7/02 | 173/196 |
| 2,848,196 | A * | 8/1958 | Simmonds | E21B 7/02 | 173/147 |
| 2,999,605 | A * | 9/1961 | De Jarnett | E21B 19/155 | 414/22.55 |

(Continued)

FOREIGN PATENT DOCUMENTS

| | | | | |
|---|---|---|---|---|
| WO | WO 8801008 A1 * | 2/1988 | ..... | E21B 19/155 |

*Primary Examiner* — Gregory W Adams
(74) *Attorney, Agent, or Firm* — Bennett Jones LLP

(57) ABSTRACT

A mobile service rig with an integrated pipe handling assembly is provided. The rig includes an elongate frame, an attached elongate mast, and an attached a pipe handling assembly. The mast base is pivotally attached to the frame for moving the mast between horizontal and vertical orientations. The pipe handling assembly includes a pipe trough and a trough lifting arm pivotally attached to frame and pipe trough to move a pipe between a horizontal orientation and a vertical orientation collinear with the mast in the vertical orientation. The pipe handling assembly may also include a pair of pipe racks pivotally attached to the frame to extend transversely away from the frame.

15 Claims, 11 Drawing Sheets

(56) References Cited

U.S. PATENT DOCUMENTS 3,151,849 A * 10/1964 Maxon, Jr. ..... B28C 9/0418 366/41
3,217,900 A * 11/1965 Kupetzky ..... F41A 9/13 414/742
3,547,291 A * 12/1970 Lonsdale ..... B60P 1/64 414/498
3,734,210 A * 5/1973 Wilderman ..... E21B 19/20 175/219
4,068,490 A * 1/1978 Jegousse ..... F16L 1/19 405/166
4,163,626 A * 8/1979 Batterton ..... B60P 1/64 414/469
4,456,417 A * 6/1984 Gerding ..... B22D 41/56 164/363
4,465,420 A * 8/1984 Dillman ..... B60P 1/04 414/332
4,547,110 A * 10/1985 Davidson ..... E21B 19/15 294/104
4,591,006 A * 5/1986 Hutchison ..... E21B 19/20 175/52
4,821,816 A * 4/1989 Willis ..... E21B 15/00 175/57
5,294,228 A * 3/1994 Willis ..... E21B 19/155 414/22.55
5,387,071 A * 2/1995 Pinkston ..... B60P 3/125 212/232
5,931,238 A * 8/1999 Gilmore ..... E21B 19/20 175/52
6,592,297 B2 * 7/2003 Frijns ..... F16L 1/19 405/154.1
7,077,209 B2 * 7/2006 McCulloch ..... B66C 19/00 166/379
7,665,944 B2 * 2/2010 Guidroz ..... E21B 19/14 187/211
7,850,397 B2 * 12/2010 Roodenburg ..... E21B 19/155 405/166
8,297,166 B2 * 10/2012 Onuk ..... F41A 23/20 89/1.804
2003/0155154 A1 * 8/2003 Oser ..... E21B 19/155 175/52
2007/0240884 A1 * 10/2007 Fehres ..... E21B 19/155 166/380
2013/0180186 A1 * 7/2013 Konduc ..... E21B 15/00 52/119
2014/0234060 A1 * 8/2014 Penner ..... B60P 1/16 414/477

* cited by examiner 200
62
63
64
65
66
67
68
69
70
71
24
ΔX
θ
H platform
H lift

MOBILE SERVICE RIG WITH INTEGRATE PIPE HANDLING ASSEMBLY

CROSS REFERENCE TO RELATED APPLICATIONS

This application claims the priority benefit of U.S. Provisional Application No. 62/018,293 filed on Jun. 27, 2014 entitled "Mobile Service Rig With Integrated Pipe Handling Assembly", the contents of which are incorporated herein by reference.

FIELD OF THE INVENTION

The present invention is directed to the field of oil and gas drilling and well servicing operations, and in particular to mobile service rigs used in oil and gas well servicing operations.

BACKGROUND OF THE INVENTION

Service rigs are used in a wide range of oil field services, including but not limited to, logging, cleanouts, fracturing, cementing, underreaming, fishing, completion and production. Such services often require several lengths of steel pipe to be made up (i.e., successive lengths of pipe are connected together in an end-to-end fashion) as they are extended into the well bore, and subsequently broken down (i.e., successive lengths of pipe are disconnected) as they are withdrawn from the wellbore.

To facilitate service rig operations, mobile service rigs have been developed that can be mounted to a wheeled transport carrier, and driven to the relevant well site. The rigs comprise certain conventional elements, namely: a wheeled platform or frame forming the base of the rig; a mast to elevate the blocks; an elevator above the wellhead; a control center for the operator; and a power source for system power.

However, these existing service rigs have certain limitations. One limitation of existing mobile service rigs is their inability to store and handle pipe at the well site. Accordingly, a separate pipe rack and catwalk must be provided at the well site. Further, a second transport carrier is needed to move the pipe rack and catwalk to the well site, and to position them inline with the service rig. This can be challenging in congested well site environments. It also requires time during which the service rig cannot be used.

A further limitation of existing mobile service rigs is that their masts have limited length. Transportation laws regulate the maximum permissible length of overhangs at each end of the transport carriers. Further, the weight of the mast needs to be balanced over the axles of the transport carrier to maintain safe handling characteristics of the transport carrier. At the same time, however, the masts are attached to the frames at a fixed position so that, when the masts are erected, their mast bases will engage the ground surface. These competing considerations prevent the masts from reaching their potential lengths.

Still a further limitation of existing service rigs is that their draw works are driven indirectly by an engine through a gearbox and drive line. As the engines accelerate to their power band, the amount of power supplied to the draw works varies. This can make it difficult to precisely control the draw works. When the engines are operating out of their power band, their fuel efficiency is sub-optimal. Further, the gearbox and drive line result in mechanical losses of the engine's power, thus decreasing the overall efficiency of the draw works.

Accordingly, there is a need for a mobile service rig that mitigates at least some of the limitations of mobile service rigs in the prior art.

SUMMARY OF THE INVENTION

In one aspect, the present invention provides a mobile service rig comprising:

(a) a mobile elongate frame defining a longitudinal axis and a transverse axis perpendicular to the longitudinal axis in a substantially horizontal plane;

(b) a mast assembly comprising an elongate mast, substantially aligned longitudinally with the frame and extending from a mast base to a mast crown, wherein the mast base is pivotally attached to the frame and moveable between a substantially horizontal orientation and a substantially vertical orientation; and (c) a pipe handling assembly attached to the frame and comprising:

(i) an elongate pipe trough substantially aligned longitudinally with the frame; and (ii) at least one trough lifting arm having a first end pivotal in relation to the frame, and a second end pivotally attached to the pipe trough for moving the pipe trough between a horizontal orientation and an orientation collinear with the mast.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF EMBODIMENTS

Figure 1A:
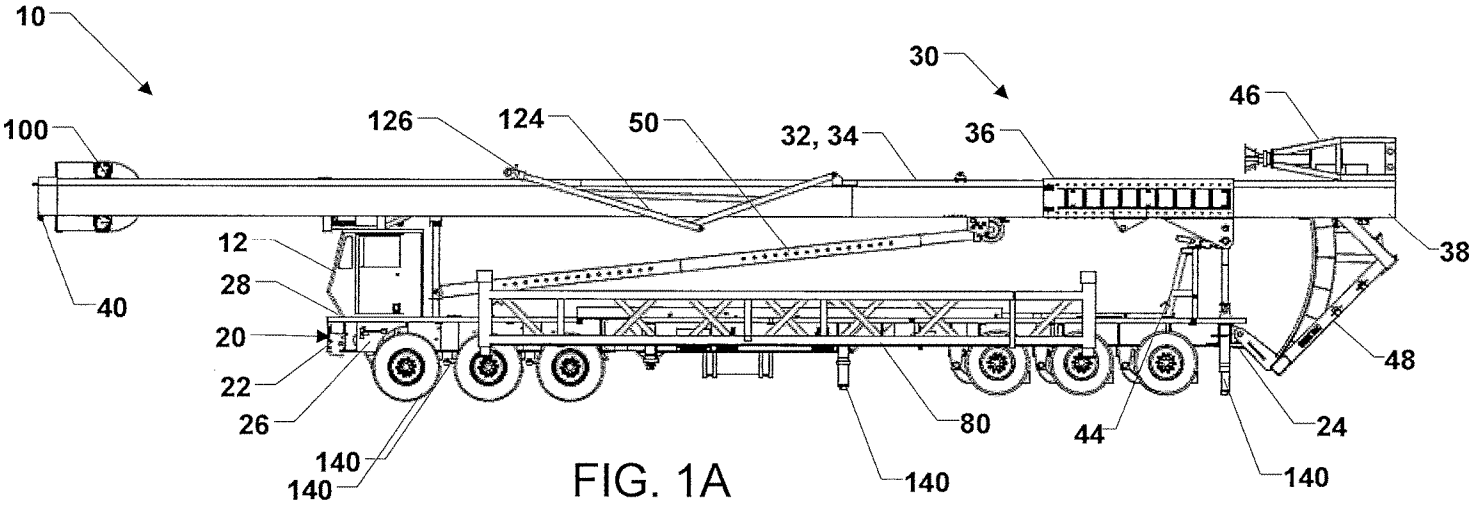
FIG. 1A is a side view of one embodiment of the service rig of the present invention, with the mast and pipe racks in the transport configuration.

Embodiments of the present invention are directed to a mobile service rig having an integrated pipe handling assembly. As used herein, the term "mobile" in describing a service rig shall mean that it is able to move or be moved readily along a ground surface. As used herein, the term "pipe" shall refer to any type of elongate tubular oil field pipe including, without limitation, drill pipe, casing, and production tubing.

In general, the mobile service rig (10) of the present invention comprises a wheeled frame (20), a mast assembly (30) comprising a mast, and a pipe handling assembly (60) comprising a pipe trough (62) and, optionally, a pipe rack (80). In one embodiment, the rig (10) may further comprise a hydraulically powered draw works (100), a hydraulically powered elevator (110), work platforms (120, 122), and hydraulically powered rig jack assemblies (140).

The frame (20) provides an elongate support structure for the mast assembly (30), and the pipe handling assembly (60), so that these components can be readily transported along a ground surface. The length of the frame (20) defines a longitudinal axis, and a transverse axis that is perpendicular to the longitudinal axis, in a substantially horizontal plane. In one embodiment, as may be seen in FIG. 1A, the frame (20) forms part of a wheeled transport carrier (12), which may be a trailer or may be self-propelled. The frame (20) has a substantially rectangular shape in the horizontal plane, extending from a front end (22) to a rear end (24). The frame (20) may be constructed from longitudinal girders (26) that span over the wheel axles of the transport carrier (12), joists (not shown) that span transversely between the girders (26), and a platform (28) attached on top of the girders (26) and joists to provide a working surface for the operators and a temporary staging area for pipes (100).

The mast assembly (30) comprises an elongate mast that can be erected over a well bore so that a draw works mounted to the mast can push or pull pipe into and out of a well bore. A similar mast assembly is described in co-pending U.S. patent application Ser. No. 13/913,976, Mobile Coiled Tubing Unit, filed Jun. 10, 2013, the entire contents of which are incorporated herein for all purposes, where permitted.

Figure 3A:
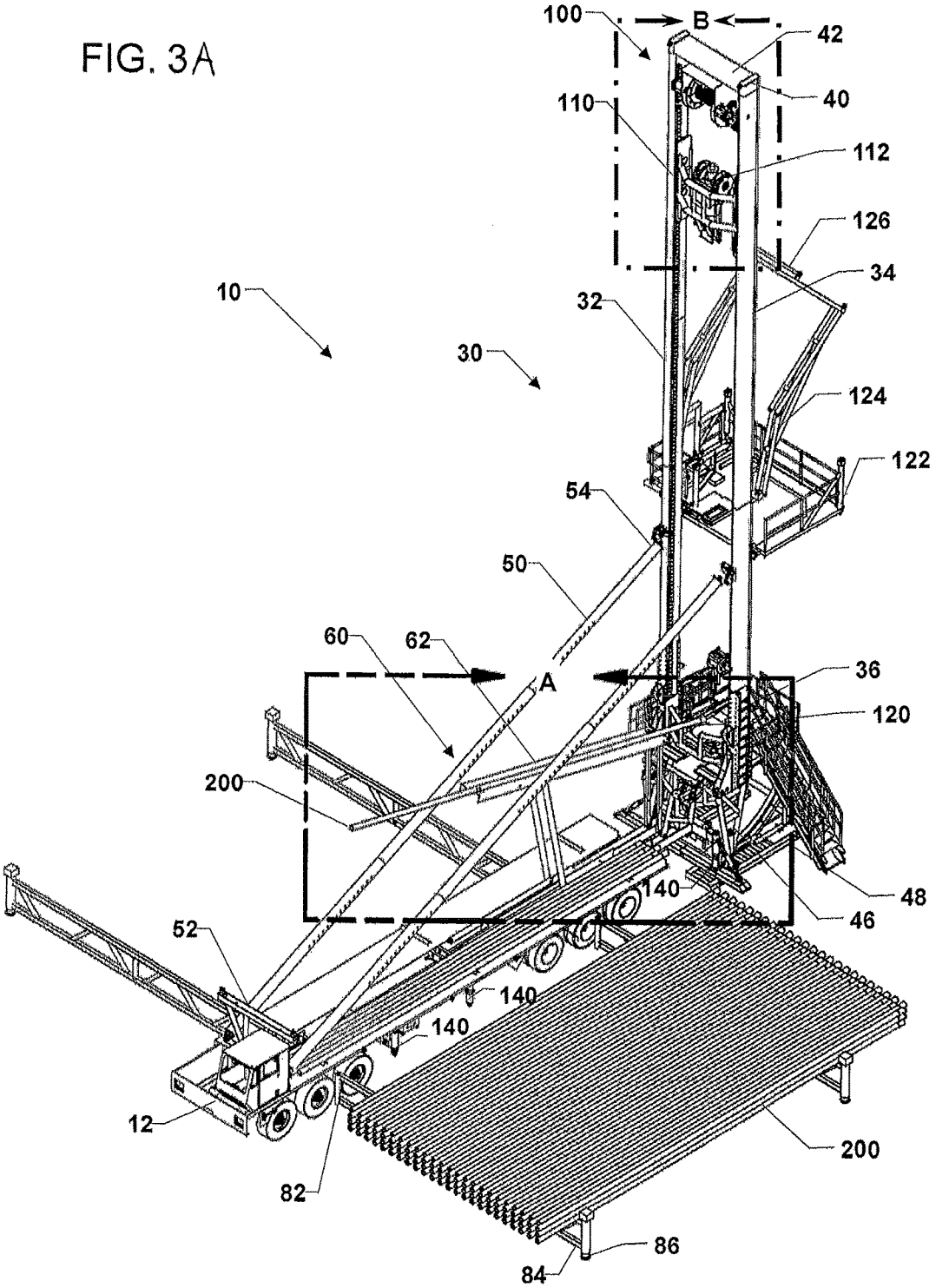
FIG. 3A is a perspective view of the embodiment of the service rig of FIG. 1, with the mast and pipe racks in the deployed configuration.
Figure 3B:
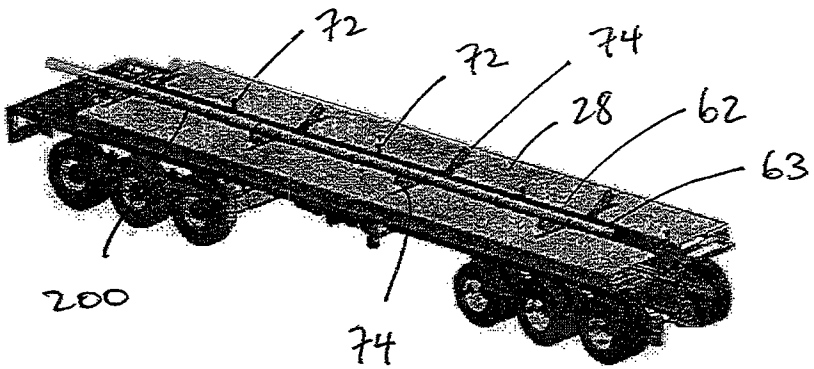
FIG. 3B is a top plan view of the frame platform showing one embodiment of the pipe kicker assembly.
Figure 3C:
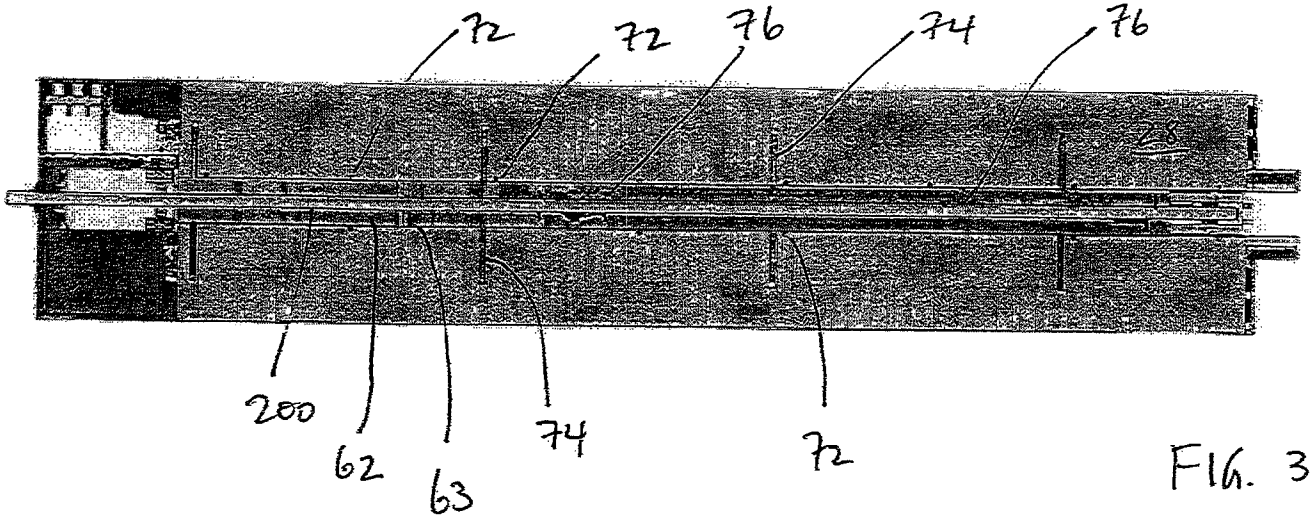
FIG. 3C is an perspective view of the embodiment of FIG. 3B.

In one embodiment, as may be seen in FIGS. 1A and 3, the mast has a substantially rectangular shape formed by two elongate, parallel and interconnected mast members (32, 34), extending from the mast base (38) to the mast crown (40). In one embodiment, the elongate mast members (32, 34) have a total length of about 75 feet. At the mast crown (40), the two elongate mast members (32, 34) are connected together by a transverse cross member (42). Each elongate mast member (32, 34) slides lengthwise within one of two mast sleeves (36), which may be closed boxes or C-shaped channels, The mast sleeves (36) are pivotally attached to a pair of A-shaped arms (44) located near the rear end (24) of the frame (20). The A-shaped arm (44) is attached to a track (63), which is actuated by a hydraulic piston to slide longitudinally, along with the attached A-shaped arm (44), in relation to the frame (20). At the mast base (38), each of the elongate mast members (32, 34) has a pivotally attached trussed mast support (46) and an attached mast foot (48), which is also pivotally attached to the rear end (24) of the frame (20).

A pair of telescoping mast lifting arms (50) has a lower end (52) pivotally attached to the frame (20) and an upper end (54) pivotally attached to the mast between the mast base (38) and the mast crown (40). The mast lifting arms (50) are hydraulically powered to extend telescopically.

The components of the mast assembly (30) allow the mast to be moved from a transport configuration when the rig (10) is being transported on public roads, to a deployed configuration in which the mast is position over a well bore. This movement is described in one embodiment of the mast assembly (30) as follows. In the transport configuration, as shown in FIG. 1A, the elongate mast members (32, 34) are in a substantially horizontal orientation and extended longitudinally rearward within the mast sleeves (36) so that their overhangs at the front end (22) and rear end (24) of the frame (20) are approximately equal. In one embodiment, each of the front and rear overhangs are about 16 feet long measured from the front or rear end of the mast, respectively, to the central front or rear axle of the transport carrier (12), respectively. The trussed mast supports (46) are folded against the elongate mast members (32, 34). The track (63) is positioned in a forward position in the frame (20) so that the rear end of the track (63) is co-terminal with the end of the frame (20).

Figure 1B:
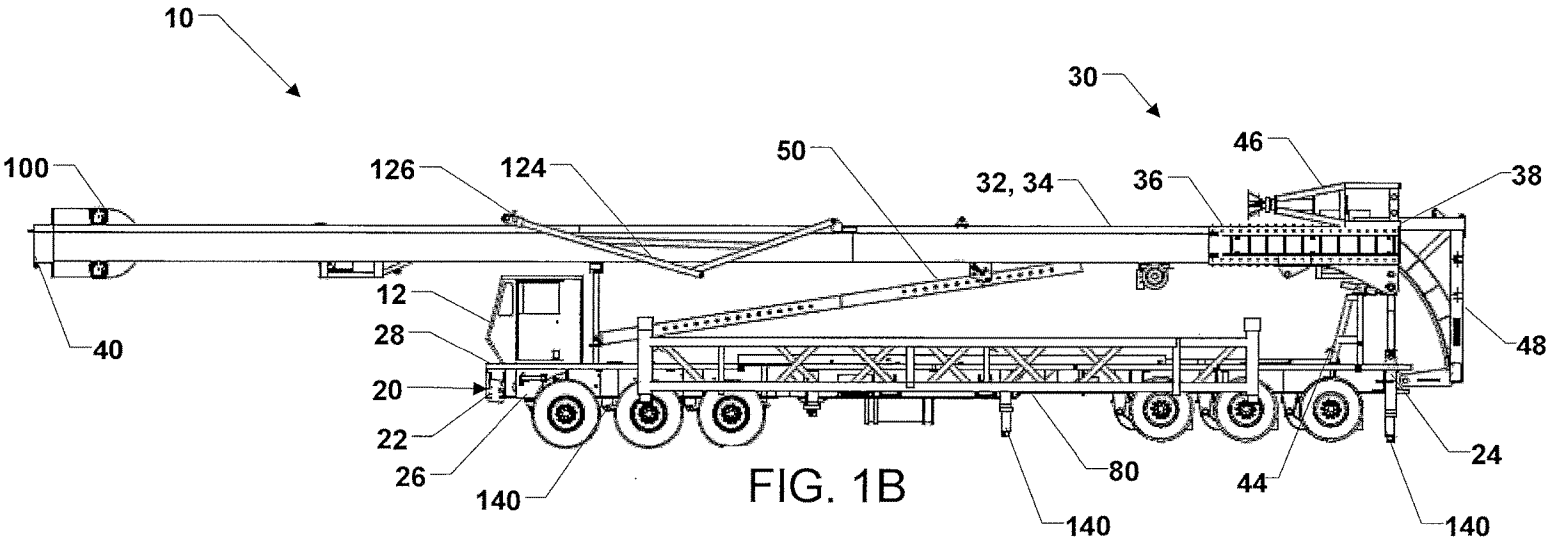
FIG. 1B is a side view of the embodiment of the rig of FIG. 1, with the mast in an intermediate configuration.
Figure 2:
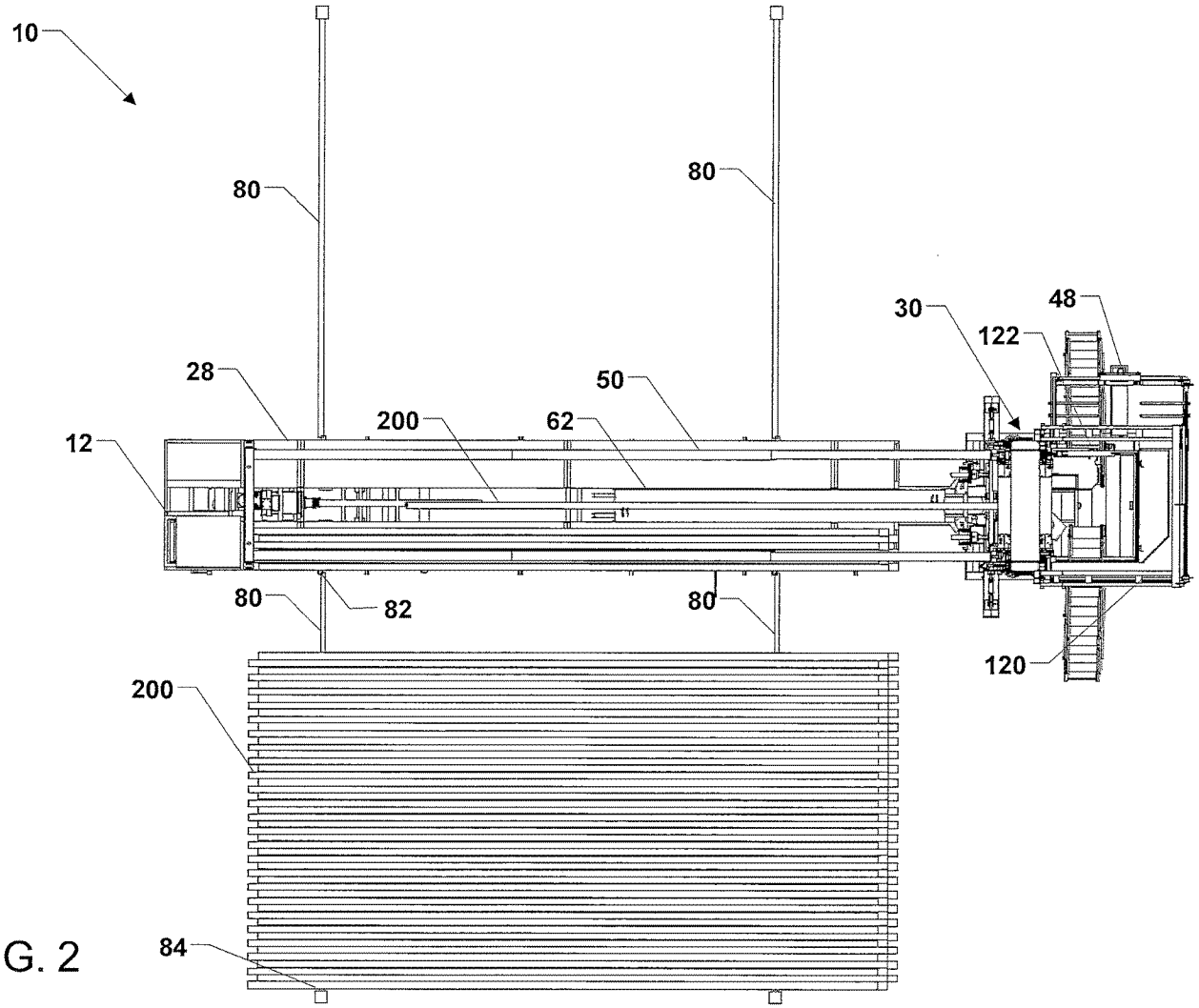
FIG. 2 is a top view of the embodiment of the service rig of FIG. 1, with the mast and pipe racks in the deployed configuration.
Figure 4:
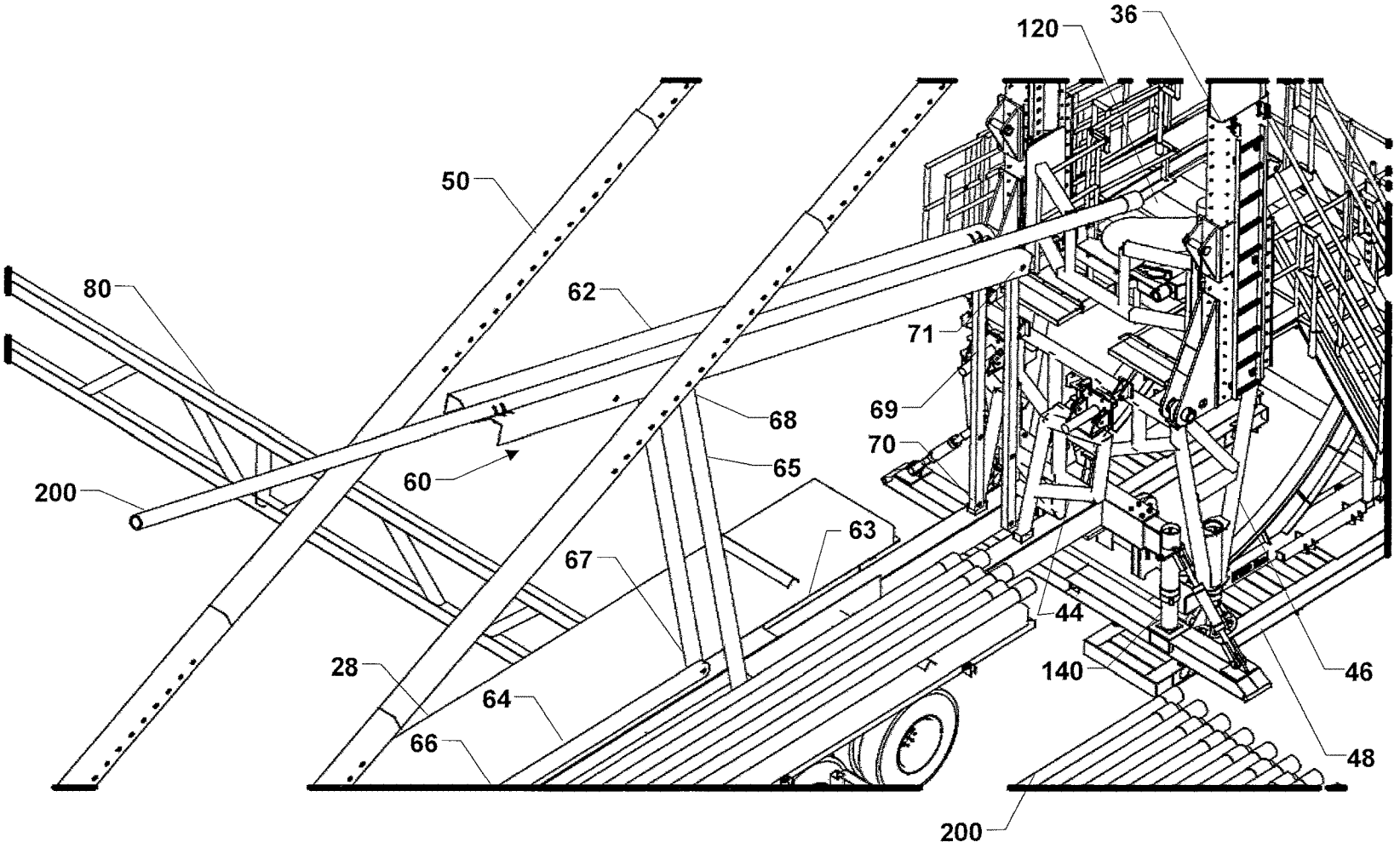
FIG. 4 is an enlarged view of detail "A" of FIG. 3 showing one embodiment of the trough lifting assembly.

Once the rig (10) has been positioned adjacent a wellbore, the rig (10) is prepared for raising the mast by placing the mast in an intermediate configuration, as shown in FIG. 1B, by sliding the elongate mast members (32, 34) longitudinally forward within the mast sleeves (36). To move the mast into the deployed configuration, as shown in FIG. 3, a hydraulic piston (not shown) slides the track (63) longitudinally rearward in relation to the frame (20) so that a portion of the track (63) cantilevers from the rear end (24) of the frame (20) and positions the attached A-shaped arm (44) and mast base over the wellbore, as shown in FIGS. 3 and 4. Next, the mast lifting arms (50) extend telescopically to push the elongate mast members (32, 34) upwards, and cause them to pivot about the connection of the mast sleeves (36) and the mast foot (48) to the frame (20). When the mast is substantially vertical, the mast is supported on the ground surface by the mast foot (48) and the trussed mast supports (46), which are pivoted to engage the ground surface. Although FIG. 3 shows the mast in a substantially vertical orientation, the angle of the foot (48) in relation to the mast (32, 34) may be adjusted so that the mast may be inclined at any desired angle between its horizontal and vertical orientations for servicing slant-drilled well bores.

The pipe handling assembly (60) is used to deliver a pipe (200) from a substantially horizontal orientation to an orientation parallel with the mast, whether it is vertical or at a slant angle, and preferably aligned collinearly within the mast over the borehole. In embodiments, the pipe handling assembly (60) may also lift the pipe (200) vertically upwards from the frame platform (28). In one embodiment, as shown in FIG. 4, the pipe handling assembly (60) comprises a pipe trough (62), an elongate track which may be track (63) described above, a pair of first trough lifting arms each comprising articulated lower segments (64) and upper segments (65) for lifting an intermediate or forward portion of the trough, and a pair of second trough lifting arms (69) for lifting a rearward portion of trough. The pipe trough (62) may be constructed from an elongate member, longitudinally aligned with the frame (20), and having a U-shaped or V-shaped channel that defines a pipe receiving surface. A suitable mechanism may be used to prevent the pipe (200) from sliding out of the pipe trough (62). The track (63) is attached to the frame (20) and aligned longitudinally with the midline of the frame (20) at the elevation of the platform (28). As described above, a hydraulic piston moves the track (63) longitudinally in relation to the frame (20). The lower ends of the first trough lifting arm (64) move longitudinally along the track (63) and are pivotally attached thereto by a pin (66). The upper ends of the first trough lifting arms (65) are pivotally attached to the pipe trough (62) by a pin (68). The articulated segments (64, 65) of the first trough lifting arms are pivotally attached to each other by a pin (67). The lower ends of the second trough lifting arms (69) are pivotally attached to the track (63) by a pin (70), while the upper ends of the second trough lifting arms (69) are pivotally attached to the pipe trough (62) by a pin (71). Hydraulic pistons (not shown) or other suitable mechanical mechanisms such as cable drives, chain drives, or gear drives may be used to drive the motion of components of the pipe handling assembly (60).

Figures 5A, 5B, 5C, 5D, 5E:
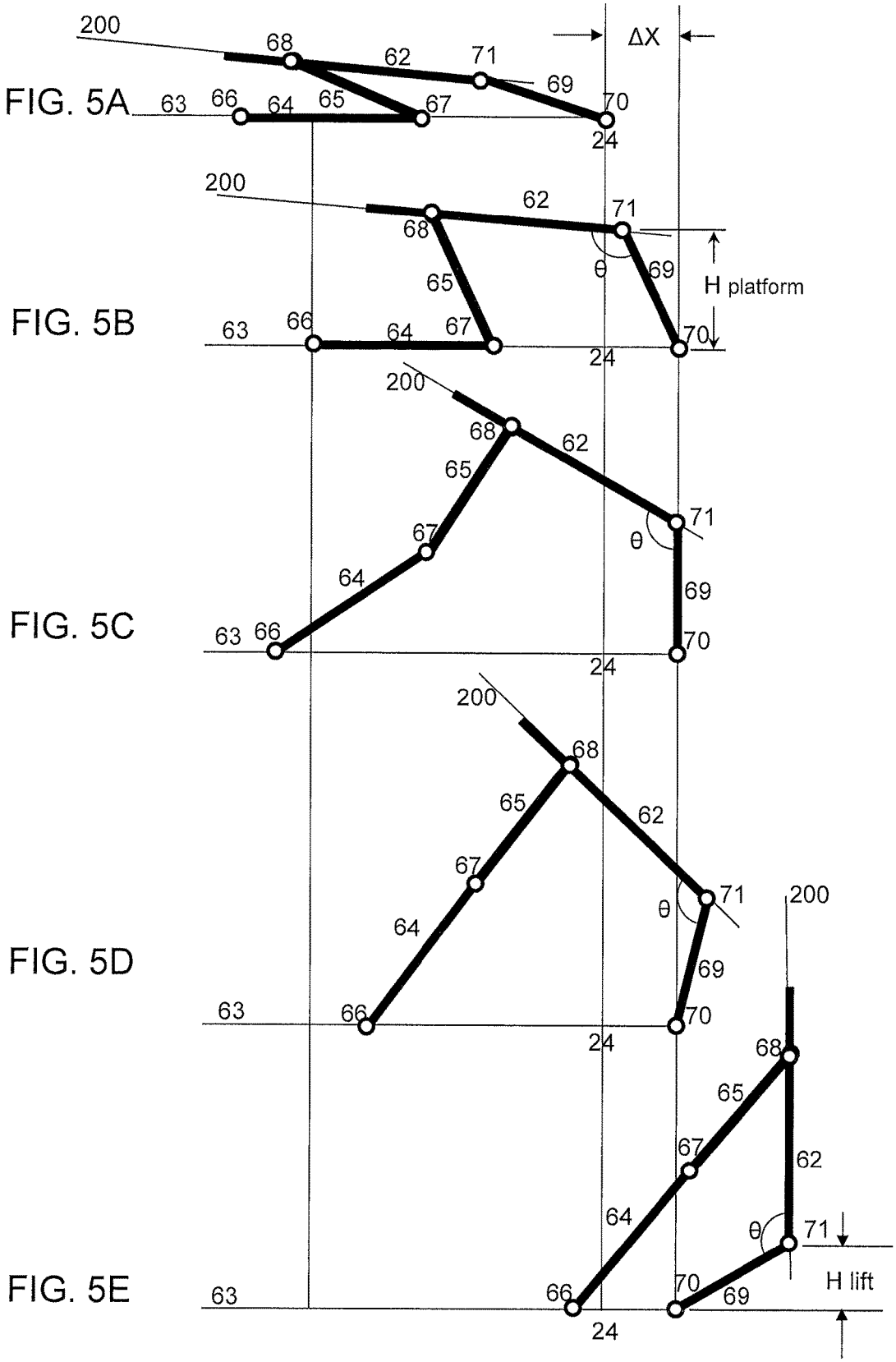
FIGS. 5A-5E are schematic side views of various stages of the deployment of one embodiment of the trough lifting assembly.

The components of the pipe handling assembly (60) allow the pipe trough (62) to be moved from a horizontal position (transport position) substantially level with the frame (20) to a pipe delivery position parallel and/or collinear with the mast and elevated to the mast base. This movement is described in one embodiment of the pipe handling assembly (60) as follows. FIG. 5A shows the pipe trough (62), first trough lifting arms (64, 65), and second trough lifting arms (69) rotated slightly upwards from the transport configuration to more clearly shown their relationship to each other. However, it will be appreciated that in the transport configuration, the pipe trough (62), the first trough lifting arms (64, 65) and the second trough lifting arm (69) are configured to lay in a substantially horizontal orientation with the pipe trough (62) overlapping the first trough lifting arms (64, 65). Further, the top surface of the pipe trough (62) is substantially level with the platform (28).

Figure 6A:
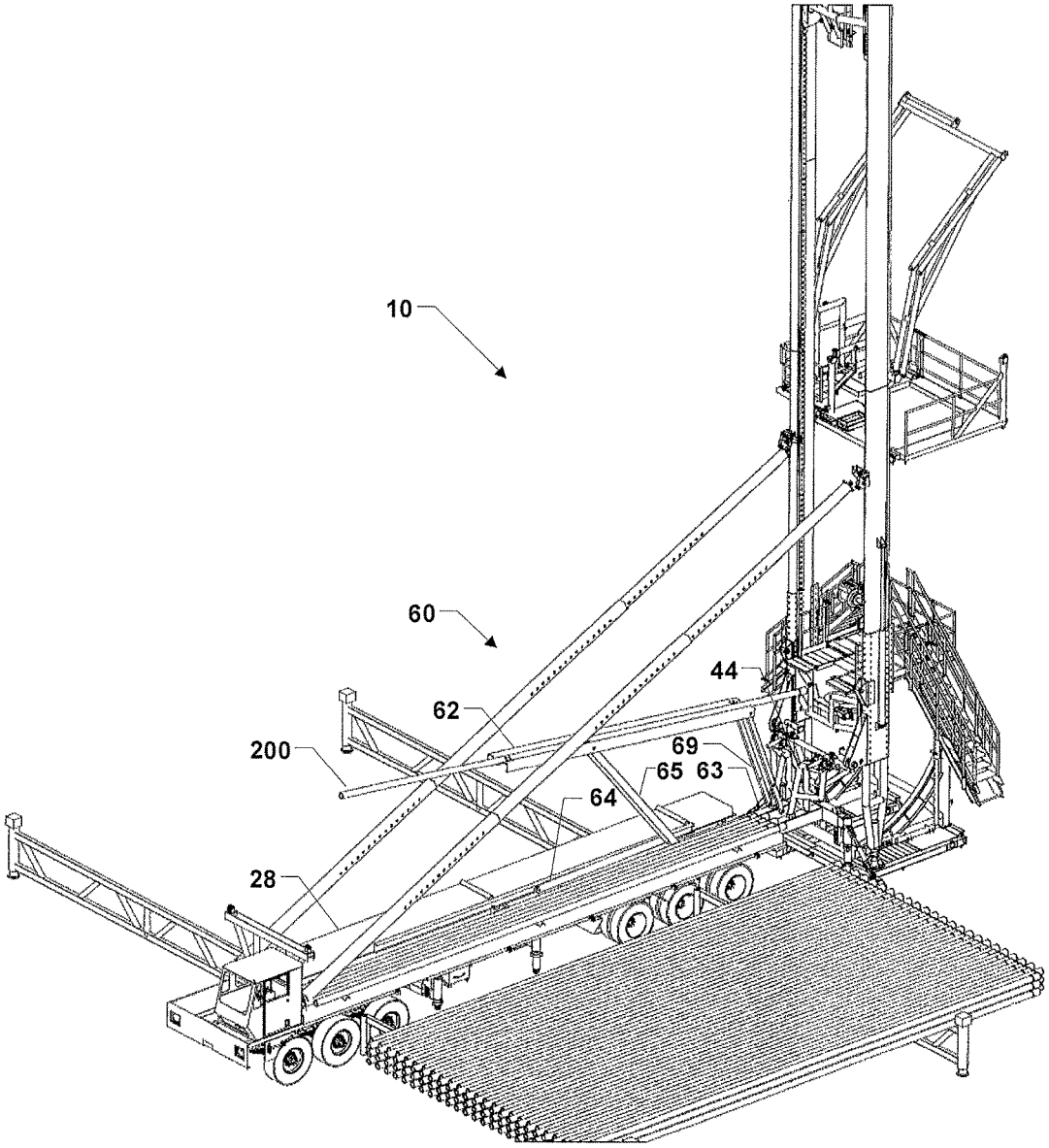
FIGS. 6A-6C are perspective views of the embodiment of the service rig of FIG. 1, showing various stages of the deployment of the trough lifting assembly.

At the next stage, as shown in FIGS. 5B and 6A, a hydraulic piston or other suitable mechanism drives the track (63) longitudinally rearwards in relation to the frame (20). Each of the pivot points (66, 67 and 70) are displaced rearwards, indicated by $\Delta X$ in FIG. 5B, The rearward displacement of the first trough lifting arms (64, 65), second trough lifting arms (69) prepares the pipe trough (62) to be positioned over the wellbore. The second trough lifting arm (69) is then pivoted clockwise about pin (70) and segment (65) rotated upwards about pin (67). This causes the pipe trough (62) to move upwards but still be in a relatively horizontal position. The rotation of the second trough lifting arm (69) continues until it forms a desired angle $\theta$ with the pipe trough (62). At this point, a ratchet or other suitable locking mechanism prevents further relative rotation of the pipe trough (62) and second trough lifting arm (69) about pin (71). At the end of this stage, the pipe trough (62) is in a substantially horizontal orientation with one end at the elevation (H platform) of the lower work platform (120). Thus, this pipe trough (62) can be used to deliver pipe to the lower work platform (120).

Figure 6B:
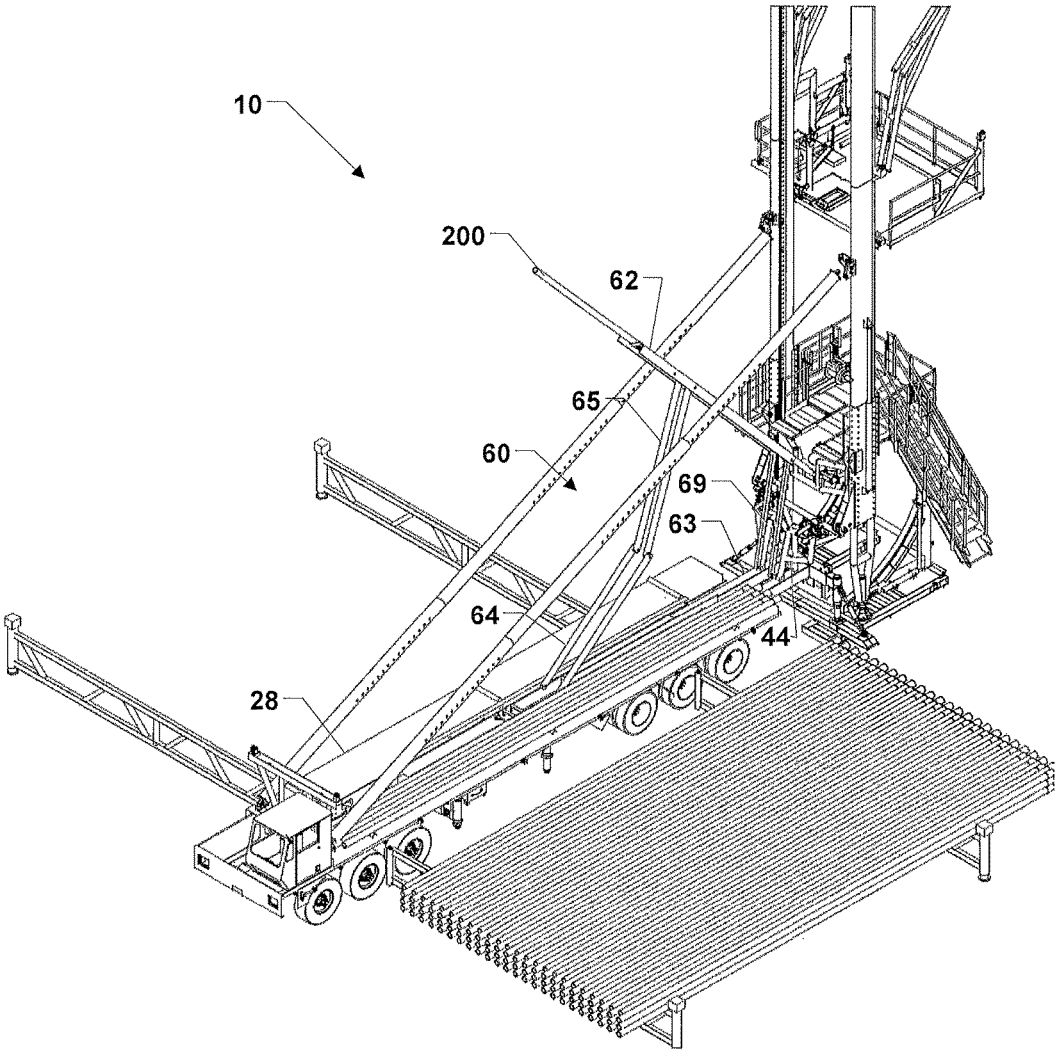

At the next stage, as shown in FIGS. 5C and 6B, the lower end of the first trough lifting arms (64) are driven longitudinally forward along the track (63). This causes the segment (64) and (65) of the first trough lifting arm to rotate into alignment with each other. At this point, a ratchet or other suitable locking mechanism prevents further relative rotation of segment (64) and segment (65) about pin (67).

Figure 6C:
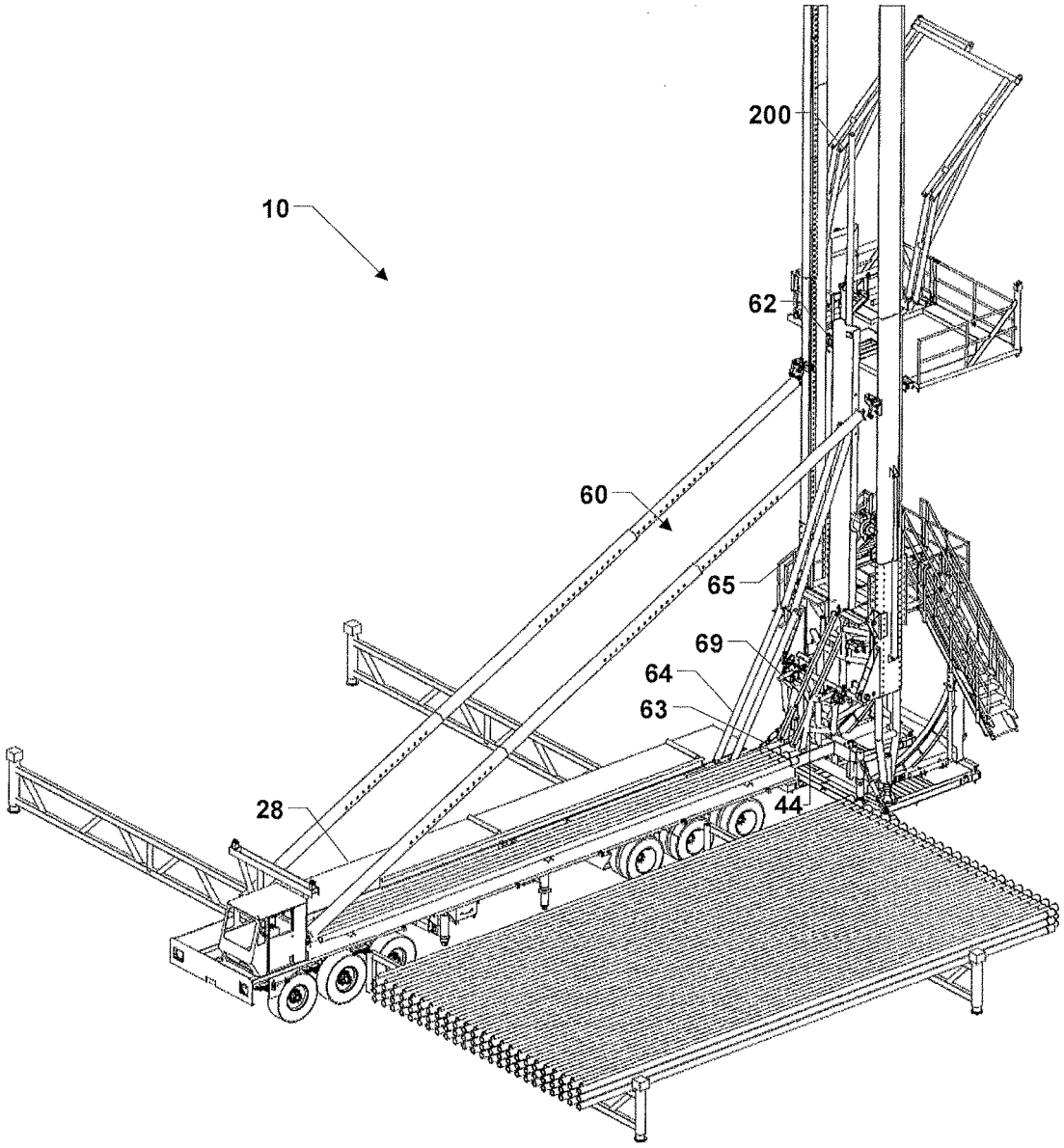

At the next stage, as shown in FIG. 5D, the lower end of the first trough lifting arm (64) is driven longitudinally rearwards along the track (63). This causes the pipe trough (62) to rotate clockwise, until the pipe trough (62) is pushed into a substantially vertical orientation, and into collinear alignment with the mast, as shown schematically in FIGS. 5E and 6C. As shown in Figure SE, the pipe trough (62) has also been lifted an amount (H lift) from the track (63) towards the mast crown (40). In this position, the pipe (200) retained by the pipe trough (62) is in substantially vertical position, ready to be engaged by a top drive (112) attached to elevator (110).

It will be appreciated that the pipe trough (62) may be returned to a horizontal orientation by reversing the process described above. It will further be appreciated that by controlling the degree of rotation of the segments of the first trough lifting arms (64, 65) with respect to each other, and the second trough lifting arms (69) with respect to the pipe trough (62), as well as the travel of the lower end of the first trough lifting arms (64, 65) along the track (63), the pipe trough (62) may be lifted by a selected distance and rotated to any desired angle between its horizontal and vertical orientations for alignment with the mast when used to service slant-drilled well bores.

In one embodiment, the pipe handling assembly (60) may also comprise a pair of elongate pipe racks (80) for staging a plurality of pipes (200) before and after loading onto the pipe trough (63). In one embodiment, as may be seen in FIGS. 1 and 3, a pair of elongate pipe racks (80) is provided on each side of the frame (20). In this embodiment, each pipe rack (80) is constructed from an elongate open-web truss, in a substantially horizontal orientation. In one embodiment, each pair of pipe racks (80) may have a capacity of about 2,200 m, and 150,000 lbs of pipe. Each pipe rack (80) has a first end (82) hingedly attached to the frame (20) and a free second end (84). The first ends (82) of the pipe racks (80) within each pair are longitudinally spaced apart on the same side of the frame (20). As shown in FIG. 1A, when the rig (10) is in a transport configuration, each pipe rack (80) is folded in towards the frame (20) so that it is substantially aligned longitudinally with the frame (20). In contrast, as shown in FIG. 3, when the rig (10) is the deployed configuration, each pipe rack (80) is pivoted outwardly so as to extend transversely from the frame (20). Thus the pair of pipe racks (80) supports the pipes (200) at two points along their length. A hydraulically powered foot (86) attached to the second end (84) of the pipe rack (80) extends downwardly to engage the ground surface and support the free end of the pipe rack (80). To control the movement of pipes (200) from the pipe racks (80) to the pipe trough (62), the top chord of each pipe rack (80) may be configured to extend downwardly towards or away from the pipe trough (62) either by suitable configuration of the pipe rack (80) or adjusting the height of the foot (86). A number of pins (72) may be provided adjacent the pipe trough to restrain a pipe (200) which is adjacent the pipe trough, until a kicker (74) is used to push the pipe (200) over the pins (72) and into the pipe trough (62). A number of trough kickers (76) are disposed within the trough to kick pipe (200) out of the trough. In addition, or alternatively, an indexing mechanism (not shown) may be installed to index pipe into or out of the pipe trough (62).

Figure 7:
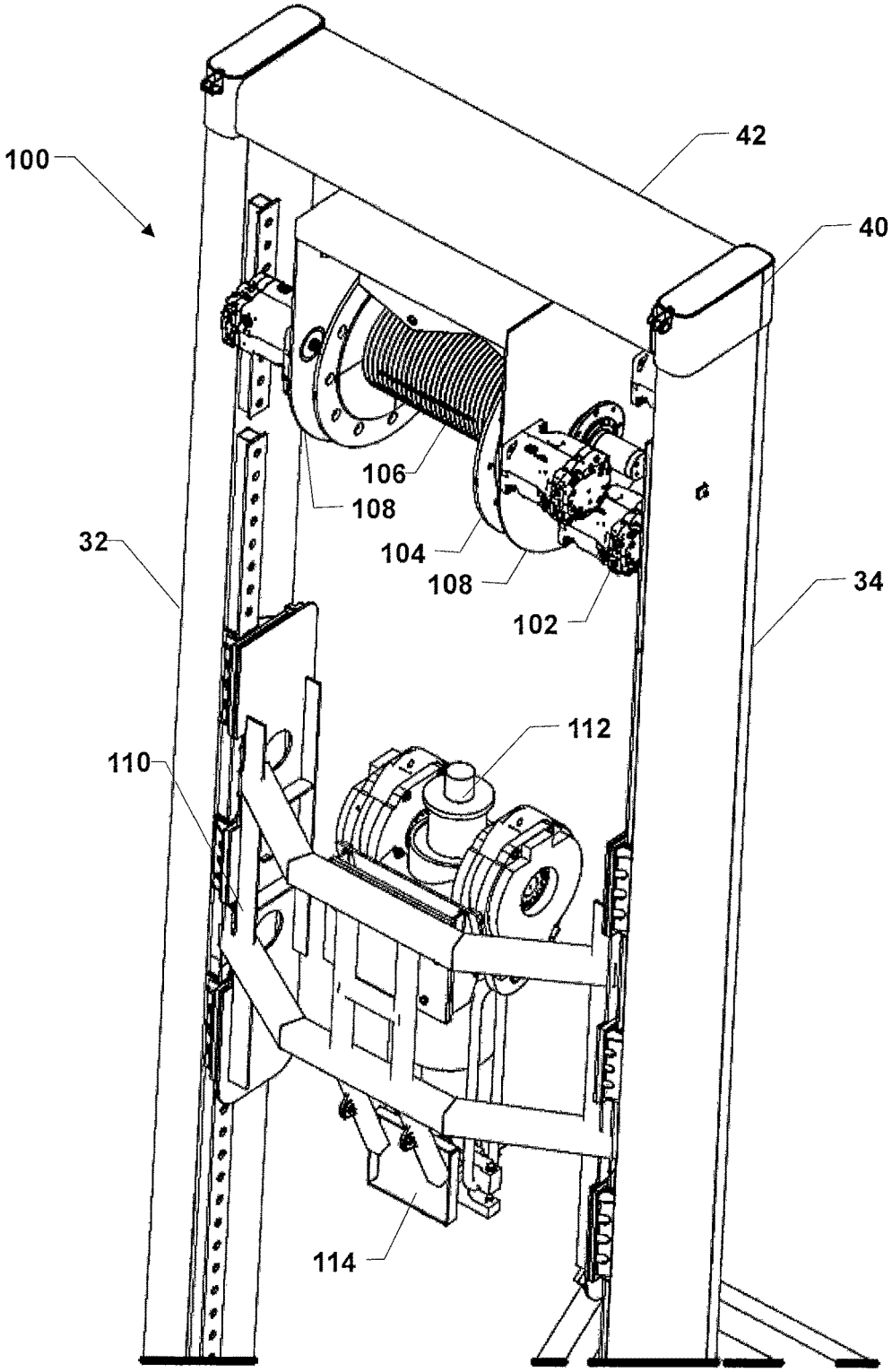
FIG. 7 is an enlarged view of detail "B" of FIG. 3 showing one embodiment of the draw works and elevator.

In one embodiment, the rig (10) also includes a hydraulically powered draw works (100) for pulling pipe (200) or other equipment out of the wellbore during well servicing operations. A hydraulically powered draw works (100) may provide a more constant power output allowing for greater control and consistency of the pull speed of the draw works than alternative power sources. In one embodiment, as best shown in FIG. 7, the draw works (100) is mounted on the mast crown (40) and comprises one or more hydraulic motors (102) that rotate a spool (104) around which a cable (106) is wound, so as to form a winch. The axle of the spool (104) is retained by a pair of end plates (108) attached to cross member (42). The motors (102) are in driving engagement with the spool (104) or its axle. The cable (106) may be attached to equipment, such as a travelling block (not shown), that needs to be suspended from the mast. Alternatively, the cable (106) can be attached to an elevator (110) or a piece of equipment attached to the elevator (110) such as a top drive (210). In one embodiment, the winch (104) has a pull capacity of about 45 daN (decaNewtons).

In one embodiment, as shown in FIG. 7, the rig (10) further comprises a hydraulically assisted elevator (110) that travels along the mast, to pull and push pipe attached to a top drive (112) up and down, during well servicing operations. A hydraulically powered elevator (110) may provide a more constant power output allowing for greater control and consistency of the push and pull speed of the elevator than alternative power sources. In one embodiment, the elevator (110) moves along the mast using a hydraulically assisted pinion gear and rack assembly (not shown) attached to the elevator (110) and inner opposing sides of the elongate mast members (32, 34). In one embodiment, the elevator (110) has a push capacity and a pull capacity of about 20 daN, and can move pipe at a speed of about 1.3 feet per second. Thus, in one embodiment, when the cable (106) wound by the spool (104) is attached to the elevator (110) or a piece of equipment attached to the elevator (110), the draw works (100) and elevator (110) have a combined pull capacity of about 65 daN, and can pull pipe at about 6 feet per second. As is known in the art, the top drive (112) rotates a pipe (200) attached via a latch mechanism (114).

In one embodiment, as shown in FIG. 3, the rig (10) also comprises a lower work platform (120) and an upper work platform (122) for operators. The upper work platform (120) comprises an outwardly extending boom (124) with an associated roller (126). In one embodiment, as shown in FIG. 3, the platforms (120, 122) and boom (124) are pivotally attached to the elongate mast members (32, 34) so that they can be folded into the mast in the transport configuration or away from the mast in the deployed configuration. Operators situated on the upper work platform (122) can use the roller (126) to deviate the cable (106) of the draw works (100) when the cable (106) is attached to light-weight equipment that can be manually handled by operators, and stored on temporarily on the upper work platform (122).

Figure 8:
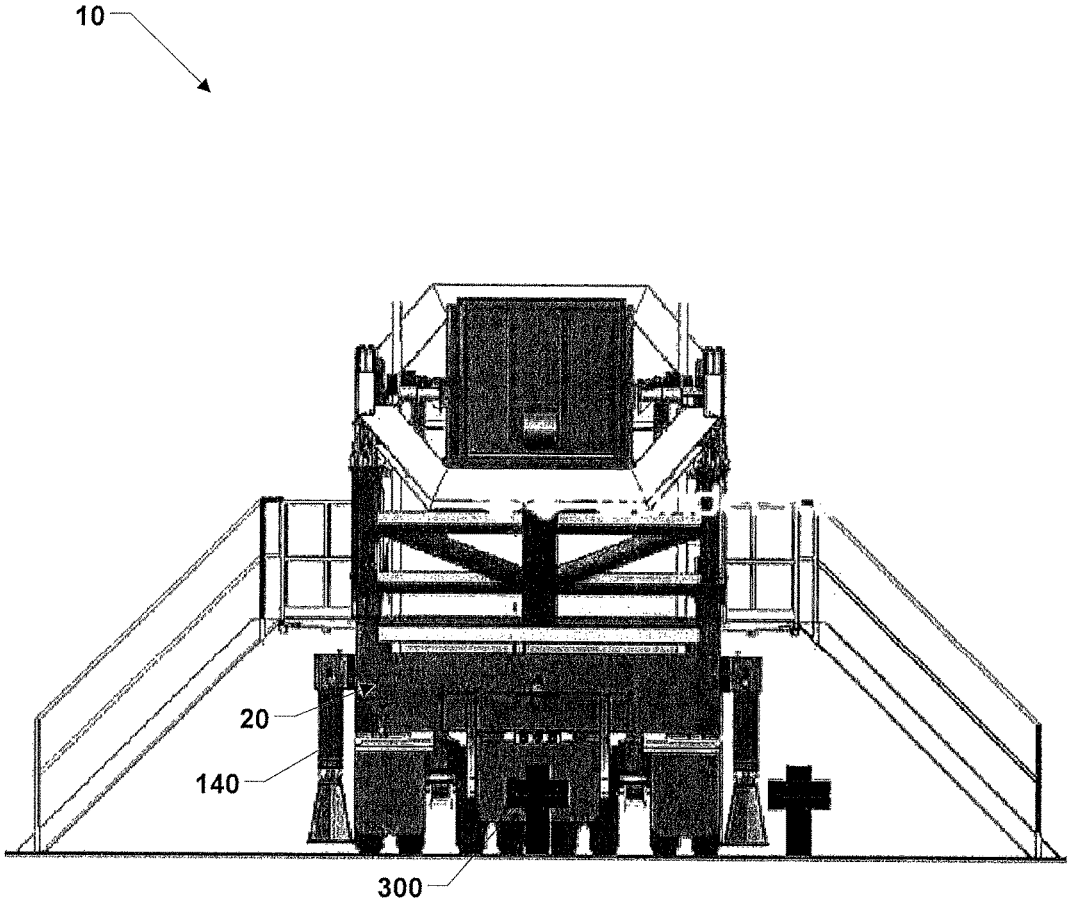
FIG. 8 is a rear view of the embodiment of the rig shown in FIG. 1 with the mast omitted for clarity, showing one embodiment of the rig jack assemblies.

In one embodiment, as shown in FIGS. 1A, 4 and 8, the rig (10) also comprises retractable hydraulic rig jack assemblies (140) that allow the mast assembly (30) and pipe handling assembly (60) to be shifted transversely to be centred over a wellbore (300). This may allow more convenient use in congested well site environments and can be used to position the rig (10) with greater precision than by driving or pulling the transport carrier (12). The rig jack assemblies (140) are positioned at the front corners and midpoint of the frame (20), and the foot (48) of the mast. The rig jack assemblies comprise a hydraulically powered telescoping piston that moves transversely in relation to the frame (20) and a hinged ground engaging jack. When deployed, the jacks support the entire rig (10), and the transversely telescoping pistons elongate and retract to allow for transverse movement (i.e., crabbing) of the entire rig (10). During transportation, the jack assemblies (140) retract into the frame (20). The jack assemblies are similar to those described in U.S. patent application Ser. No. 13/913,976.

The rig (10) may be equipped with all necessary controllers, power units, hydraulic accumulators, and hydraulic pumps for hydraulically controlling and actuating the components of the mast assembly (30), pipe handling assembly (60), draw works (100), elevator (110) and rig jack assemblies (140). These components may be housed in the cabin of the transport carrier (12), the platform (28) or one of the working platforms (120, 122). It will also be appreciated that other embodiments of the rig may use other suitable, non-hydraulic, drive mechanisms known in the art such as electric motors, gears, chain drives, or cable drives to actuate the various moving components of the rig (10).

DEFINITIONS AND INTERPRETATION

The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. Embodiments were chosen and described in order to best explain the principles of the invention and the practical application, and to enable others of ordinary skill in the art to understand the invention for various embodiments with various modifications as are suited to the particular use contemplated.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described. In other words, any element or feature may be combined with any other element or feature in different embodiments, unless there is an obvious or inherent incompatibility between the two, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

What is claimed is:

1. A mobile service rig for handling a pipe, the rig comprising:

(a) an elongate wheeled frame defining a longitudinal axis and a transverse axis perpendicular to the longitudinal axis in a substantially horizontal plane;

(b) a mast assembly comprising an elongate mast substantially aligned longitudinally with the frame and extending from a mast base to a mast crown, wherein the mast base is pivotally attached to the frame for moving the mast from a substantially horizontal orientation to a substantially non-horizontal orientation; and (c) a pipe handling assembly attached to the frame and comprising:

(i) an elongate pipe trough substantially aligned longitudinally with the frame; and (ii) a pipe lifting assembly for moving the pipe trough, in relation to the mast in the substantially non-horizontal orientation, between a substantially horizontal position in which the pipe trough is level with the frame and a pipe delivery position in which the pipe trough is substantially parallel with the mast and elevated above the frame, wherein the pipe lifting assembly comprises at least one trough lifting arm having a first end pivotally connected to the frame directly or indirectly, and a second end pivotally attached to the pipe trough, the at least one trough lifting arm comprises a first trough lifting arm having an end pivotally attached to the frame and another end pivotally attached to a first portion of the pipe trough, and a second trough lifting arm having an end pivotally attached to the frame and another end pivotally attached to a second portion of the pipe trough disposed longitudinally between the first portion of the pipe trough and the mast assembly when the pipe trough is in the substantially horizontal position, and wherein the first trough lifting arm is articulated between a between a lower trough lifting segment and an upper trough lifting segment, and a lower end of the first trough lifting segment is movable longitudinally in relation to the frame.

2. The rig of claim 1, wherein the pipe handling assembly further comprises an elongate track attached to and substantially aligned longitudinally with the frame, wherein the lower end of the first trough lifting arm is movable longitudinally in relation to the frame along the track, and the second trough lifting arm is attached to the track.

3. The rig of claim 2, wherein the track is movable longitudinally in relation to the frame.

4. The rig of claim 1, wherein the first trough lifting arm and second trough lifting arm are each configured to lift the pipe trough towards the mast crown.

5. The rig of claim 1, wherein the pipe handling assembly further comprises a pair of elongate pipe racks in a substantially horizontal orientation, wherein each pipe rack is pivotally attached to a side of the frame for moving between a transport configuration in which the pipe racks are substantially aligned longitudinally with the frame, and a deployed configuration in which the pipe racks extend transversely from the frame, longitudinally spaced apart from each other, to support a plurality of pipes.

6. The rig of claim 1, wherein an orientation of the pipe trough relative to the trough lifting arm resulting from pivoting of the pipe trough about the second end is selectable independently of an orientation of the trough lifting arm relative to the frame resulting from pivoting of the trough lifting arm about the first end, such that the pipe trough is movable into collinear alignment with the mast when the mast is in the substantially non-horizontal orientation.

7. The rig of claim 1, wherein the lower trough lifting segment and the upper trough lifting segment are selectively lockable against pivoting relative to each other, and wherein the second trough lifting arm and the pipe trough are selectively lockable against pivoting relative to each other.

8. A mobile service rig for handling a pipe, the rig comprising:

(a) an elongate wheeled frame defining a longitudinal axis and a transverse axis perpendicular to the longitudinal axis in a substantially horizontal plane;

(b) a mast assembly comprising an elongate mast substantially aligned longitudinally with the frame and extending from a mast base to a mast crown, wherein the mast base is pivotally attached to the frame for moving the mast from a substantially horizontal orientation to a substantially non-horizontal orientation; and (c) a pipe handling assembly attached to the frame and comprising:

(i) an elongate pipe trough substantially aligned longitudinally with the frame; and (ii) a pipe lifting assembly for moving the pipe trough, in relation to the mast in the substantially non-horizontal orientation, between a substantially horizontal position in which the pipe trough is level with the frame and a pipe delivery position in which the pipe trough is substantially parallel with the mast and elevated above the frame, wherein the pipe lifting assembly comprises at least one trough lifting arm having a first end pivotally connected to the frame directly or indirectly, and a second end pivotally attached to the pipe trough, wherein the at least one trough lifting arm comprises a first trough lifting arm having an end pivotally attached to the frame and another end pivotally attached to a first portion of the pipe trough, and a second trough lifting arm having an end pivotally attached to the frame and another end pivotally attached to a second portion of the pipe trough, wherein the second portion of the pipe trough is disposed longitudinally between the first portion of the pipe trough and the mast assembly when the pipe trough is in the substantially horizontal position, and (iii) wherein the pipe handling assembly further comprises an elongate track attached to and substantially aligned longitudinally with the frame, wherein the lower end of the first trough lifting arm is movable longitudinally in relation to the frame along the track, and the second trough lifting arm is attached to the track.

9. The rig of claim 8 wherein the first trough lifting arm is articulated between a between a lower trough lifting segment and an upper trough lifting segment, and a lower end of the first trough lifting segment is movable longitudinally in relation to the frame.

10. The rig of claim 8, wherein the pipe handling assembly further comprises an elongate track attached to and substantially aligned longitudinally with the frame, wherein the lower end of the first trough lifting arm is movable longitudinally in relation to the frame along the track, and the second trough lifting arm is attached to the track.

11. The rig of claim 8, wherein the track is movable longitudinally in relation to the frame.

12. The rig of claim 8, wherein the first trough lifting arm and second trough lifting arm are each configured to lift the pipe trough towards the mast crown.

13. The rig of claim 8, wherein the pipe handling assembly further comprises a pair of elongate pipe racks in a substantially horizontal orientation, wherein each pipe rack is pivotally attached to a side of the frame for moving between a transport configuration in which the pipe racks are substantially aligned longitudinally with the frame, and a deployed configuration in which the pipe racks extend transversely from the frame, longitudinally spaced apart from each other, to support a plurality of pipes.

14. The rig of claim 8, wherein an orientation of the pipe trough relative to the trough lifting arm resulting from pivoting of the pipe trough about the second end is selectable independently of an orientation of the trough lifting arm relative to the frame resulting from pivoting of the trough lifting arm about the first end, such that the pipe trough is movable into collinear alignment with the mast when the mast is in the substantially non-horizontal orientation.

15. The rig of claim 8, wherein the lower trough lifting segment and the upper trough lifting segment are selectively lockable against pivoting relative to each other, and wherein the second trough lifting arm and the pipe trough are selectively lockable against pivoting relative to each other.

* * * * *